US010731454B2

(12) United States Patent
Gawski et al.

(10) Patent No.: US 10,731,454 B2
(45) Date of Patent: Aug. 4, 2020

(54) MONITOR AND CONTROL OF DIRECTIONAL DRILLING OPERATIONS AND SIMULATIONS

(71) Applicant: Halliburton Energy Services, Inc., Houston, TX (US)

(72) Inventors: Victor Gawski, Aberdeenshire (GB); John Kenneth Snyder, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 233 days.

(21) Appl. No.: 15/893,792

(22) Filed: Feb. 12, 2018

(65) Prior Publication Data

US 2018/0171776 A1 Jun. 21, 2018

Related U.S. Application Data

(63) Continuation of application No. 14/710,088, filed on May 12, 2015, now Pat. No. 9,915,139, which is a (Continued)

(51) Int. Cl.

| | |
|---|---|
| ***E21B 44/04*** | (2006.01) |
| ***E21B 7/04*** | (2006.01) |
| ***E21B 44/02*** | (2006.01) |

(52) U.S. Cl.

CPC ..... *E21B 44/04* (2013.01); *E21B 7/04* (2013.01); *E21B 44/02* (2013.01)

(58) Field of Classification Search

CPC ..... E21B 44/04

See application file for complete search history.

(56) References Cited

U.S. PATENT DOCUMENTS 5,679,894 A * 10/1997 Kruger ..... E21B 4/02 175/39
6,944,547 B2 * 9/2005 Womer ..... E21B 44/00 702/7

(Continued)

FOREIGN PATENT DOCUMENTS

| | | |
|---|---|---|
| EP | 2802739 A1 | 6/2016 |
| GB | 2378017 A | 5/2001 |

OTHER PUBLICATIONS

CA Application Serial No. 2,997,840, Office Action, dated Jun. 27, 2019, 3 pages.

(Continued)

*Primary Examiner* — Robert E Fuller
(74) *Attorney, Agent, or Firm* — Gilliam IP PLLC

(57) ABSTRACT

In some embodiments, a method includes performing a directional drilling operation using a drill string having a drilling motor and cutting structures that include a drill bit and a reamer. The method includes receiving data from one or more sensors, wherein at least one of the one or more sensors output data related to at least one performance attribute associated with load monitoring between the drill bit and the reamer. The load monitoring is distributed between the drill bit and the reamer by the drilling motor. The at least one performance attribute comprises a differentiation of distribution of at least one of a weight and a torque applied to each of the drill bit and the reamer. The method includes displaying the data related to the at least one performance attribute associated with the load monitoring in a graphical and numerical representation on a graphical user interface screen.

14 Claims, 13 Drawing Sheets

Related U.S. Application Data continuation of application No. 12/442,637, filed as application No. PCT/US2007/020867 on Sep. 27, 2007, now Pat. No. 9,103,195.

(60) Provisional application No. 60/827,209, filed on Sep. 27, 2006.

(56) References Cited

U.S. PATENT DOCUMENTS

| | | | | |
|---|---|---|---|---|
| 2005/0211470 | A1* | 9/2005 | Jeffryes | E21B 10/26 175/27 |
| 2009/0229819 | A1 | 9/2009 | Repin et al. | |
| 2011/0162889 | A1 | 7/2011 | Mercer | |
| 2015/0240618 | A1 | 8/2015 | Gawski et al. | |

OTHER PUBLICATIONS

ID Application Ser. No. P-00201504733, Office Action, dated Jul. 8, 2019, 3 pages.

CA Application Serial No. 2,659,453, Office Action, dated Feb. 1, 2019, 9 pages.

CN Application Serial No. 2014800044597, Third Office Action, dated Apr. 16, 2018, 13 pages.

MX Application Serial No. MX/a/2015/009779, Office Action, dated Nov. 8, 2018, 4 pages.

MY Application Serial No. PI 2015701996, Substantive Examination Adverse Report, dated Mar. 13, 2019, 2 pages.

MX Application Serial No. MX/a/2015/009779, Second Office Action, dated Feb. 27, 2019, 4 pages.

EP Application Serial No. 14776529.1, Comm. Pursuant to Article 94(3), dated Jan. 22, 2018, 5 pages.

CN Application Serial No. 2014800044597, Fourth Office Action, dated Nov. 5, 2018, 10 pages.

MY Application Serial No. PI 20091086, Substantive Examination Report, dated Jun. 13 2014, 2 pages.

RU Application Serial No. 2015128022, Decision to Grant, dated Dec. 26, 2016, 16 pages.

CN Application Serial No. 2014800044597; Fifth Office Action; dated Sep. 12, 2019, 12 pages.

* cited by examiner

900

SNAPSHOT REPORT

| HEADER | | | | OPERATION | DRILLING |
|---|---|---|---|---|---|
| DATE: | 29/JUN/06 | TIME: | 18:30:29 | CURRENT MD: | 9240.05 FT |
| WELL: 3DI_TEST500<br>RUN: 600<br>SHA#: 1 | | FIELD:<br>RIG:<br>LOCATION: | | SLM REF:<br>JOB NUMBER:<br>CUSTOMER: | A8-MW-OD43976590-500 |

DRILLING DATA

| MD FT | INTERVAL FT | ROP FT/HR | DRILLING HOURS | CIRCULATING HOURS | REAMING HOURS | BRT HOURS | HOLE INCLINATION | HOLE AZIMUTH |
|---|---|---|---|---|---|---|---|---|
| 9240.05 | 8240.05 | | | | | | | |

| | WOB LB | OFF BOTTOM PRESSURE PSI | ON BOTTOM PRESSURE PSI | DIFFERENTIAL PRESSURE PSI | MOTOR OUTPUT RPM | STRING RPM | BIT RPM | FLOW RATE GPM | MOTOR OUTPUT TORQUE FT.LB |
|---|---|---|---|---|---|---|---|---|---|
| CURRENT: | 24089 | 2100 (EST.) | 2830 | 730 | 130 | 56 | 186 | 541 | 6078 |
| MAXIMUM: | 25669 | 2729 | 2830 | | | 76 | 209 | 548 | 6078 |

MOTOR

| | | | | | |
|---|---|---|---|---|---|
| MOTOR MODEL: | SPERRY DRILL | ROTOR TYPE: | REG | HOUSING ANGLE: | 0" |
| MOTOR SIZE: | 6-3/4 IN | STATOR TYPE: | REG | SLICKBORE: | |
| LOBS: | 6:7 | JETTED: | N | ROTOR COATING: | CHROME |
| STAGES: | 5:0 | JET SIZE: | | RUBBER TYPE: | |
| POWER UNIT: | PERFORMANCE | HOUSING: | | | |

BIT

| | | | | | |
|---|---|---|---|---|---|
| BIT SIZE: | 8.5 IN | BIT MODEL: | | GAUGE LENGTH: | |
| BIT TYPE: | TRICONA | JETS: | | AGGRESSION RATING: | |
| BIT MAKE: | | TFA | 0 IN^2 | INITIAL WEAR: | — |

MUD

| | | | | | |
|---|---|---|---|---|---|
| MUD WT: | | BASE FLUID: | | CHLORIDES: | |
| PV: | | ADDITIVES: | | MOTOR COMPATIBILITY: | LOW |
| VP: | | SAND: | | | |

MOTOR PERFORMANCE GRAPH

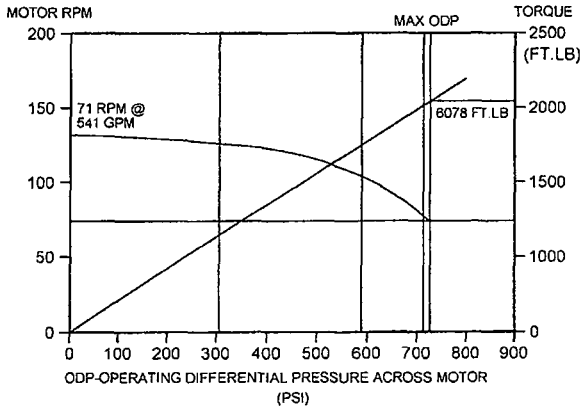

COMMENTS:

MOTOR MICRO-STALL @ 9,240 FT. 6,078 FT.LBS (+500 PSI OVER USUAL MOTOR OPERATING DIFFERENTIAL PRESSURE)

*Fig. 9*

1000

SNAPSHOT REPORT

GENERAL DATA

| | | | | | |
|---|---|---|---|---|---|
| REPORT DATE. | 09-SEP-99 | POWER UNIT TYPE: | PERFORMANCE | JOB NUMBER: | DD-#1-44-97 |
| MOTOR & BUILT INFO: | 675999 | SPEED TYPE: | LOW | REGION / FBM: | NUMBER 1 |
| MOTOR SIZE: | 5-3/4 | LOBE CFG: | 6:7 | DISTRICT: | B/2 |
| MOTOR TYPE: | REGULAR SLICKBORE | STAGES: | 5.0 | CUSTOMER: | PRIORITY # 1 |
| | | STATOR SIZE: | REG | LOCATION: | OFFSHORE AREA 2 |
| | | ROTOR SIZE: | REG | WELL: | DEEP 1 |

ROTOR DATA

| | | | | | |
|---|---|---|---|---|---|
| SERIAL NUMBER: | 686890 | COATING TYPE: | CHROME + CERAMIC | JETTED? Y | JEY SIZE: 12 (32 NOS) |
| MANUFACTURER: | MONO | STATUS: | ORIGINAL / UNUSED | PREV. CUM. HOURS: | 0.00 |

PRE-RUN VISUAL CONDITION: A1 - NO WEAR / NO DAMAGE.

POST-RUN VISUAL CONDITION: RADIAL SCORES (INTO BASE MATERIAL)-HIGH LEVEL-CREST & FLANK (LEADING): GOUGING-MEDIUM LEVEL-CREST: FOREING OBJECTS DAMAGE (MULTIPLE ITEMS)-LOCALISED-AROUND COMPLETE LOBE PROFILE: COATING INDENTATIONS (DENTS)-HIGH LEVEL-CREST & FLANK (LEADING)

STATOR DATA

| | | | | | |
|---|---|---|---|---|---|
| SERIAL NUMBER: | 234765 | RUBBER REF / TYPE: | RR / NBR-STANDARD NITRILE | TEMPERATURES (°F) | |
| MANUFACTURER: | MONO | STATUS: | ORIGINAL / UNUSED | AMBIENT PRE / POST RUN | 83.0 / 76.0 |
| HOUSING: | FLEX | HARDNESS PRE / POST RUN: | 70 / 72 | PLANNED START / END RUN: | 185.0 / 212.0 |
| | | PREV. CUM HOURS: | 0.00 | ACTUAL START / END RUN: | 195.0 / 225.0 |

PRE-RUN VISUAL CONDITION: A1 - NO WEAR / NO DAMAGE.

POST-RUN VISUAL CONDITION: RADIAL RIBBING-MEDIUM LEVEL-CREST & FLAN (LEADING): LOBE TEARING-MEDIUM LEVEL-CREST: LOOSE ('FREE') RUBBER PIECES RETRIEVED-SLIGHT: LOBE CHUNKING (LOBE TOPS)-SLOIGHT-CREST

MEASURED VALUES

| MEASUREMENTS TAKEN | TEMPERATURE WHEN MEASURED | AV.RMAJ* | ROTOR RMAJ. (MIN) | RANGE (MAX) | AV.S MIN* | STATOR SMIN. (MIN) | RANGE (MAX) |
|---|---|---|---|---|---|---|---|
| PRE-RUN | 83.0°F PRE-RUN AMBIENT | 4.311 | 4.305 | 4.321 | 3.734 | 3.709 | 3.774 |
| POST-RUN | 75.0°F POST-RUN AMBIENT | 4.309 | 4.305 | 4.321 | 3.739 | 3.711 | 3.775 |
| POST-RUN ADJ TO | 83.0°F PRE-RUN AMBIENT | 4.309 | 4.305 | 4.321 | 3.737 | 3.709 | 3.774 |
| CHANGE IN SIZE FROM PRE-RUN TO POST-RUN (ADJ.) | | -0.002 | | | 0.003 | | |

CALCULATED FIT AT SURFACE

| MEASUREMENTS TAKEN | TEMPERATURE WHEN MEASURED | FIT AT AV. SMIN | | FIT RANGE AT SMIN (LOOSEST) | | (TIGHTEST) | |
|---|---|---|---|---|---|---|---|
| PRE-RUN | 83.0°F PRE-RUN AMBIENT | 0.000 | (SIZE FOR SIZE FIT) | -0.022 | (CLEARANCE) | 0.016 | (COMPRESSION) |
| POST-RUN | 75.0°F POST-RUN AMBIENT | -0.003 | (CLEARANCE) | -0.023 | (CLEARANCE) | 0.017 | (COMPRESSION) |
| POST-RUN ADJ TO | 83.0°F PRE-RUN AMBIENT | -0.002 | (CLEARANCE) | -0.022 | (CLEARANCE) | 0.018 | (COMPRESSION) |
| CHANGE IN FIT FROM PRE-RUN TO POST-RUN (ADJ.) | | -0.002 | | | | | |

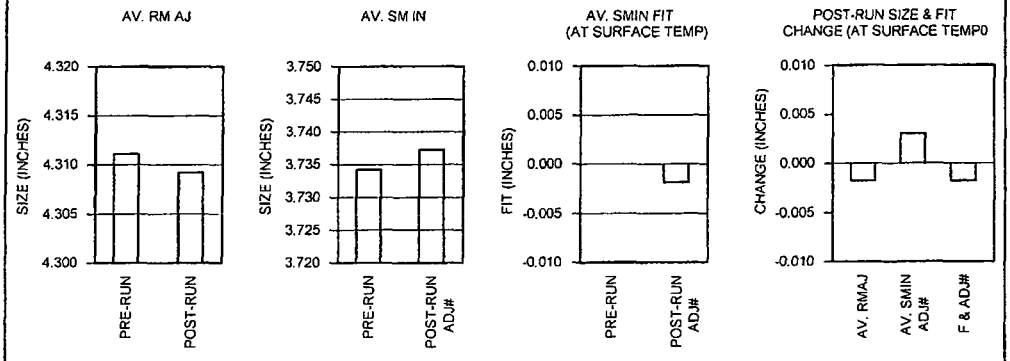

* AX. RMAJ IS THE AVERAGE LOBE CREST TO CREST DIAMETER OF THE ROTOR. AV. SMIN IS THE AVERAGE LOBE CREST TO CREST DIAMETER OF THE STATOR.
AV. SMIN MEASUREMENT AT POST-RUN AMBIENT TEMPERATURE ADJUSTED TO PRE-RUN AMBIENT TEMPERATURE FOR REFERENCE PURPOSES.

*Fig. 10*

1100

SIZE AND FIT SUMMARY REPORT (2)

CALCULATED FIT AT START OF RUN

| MEASUREMENTS TAKEN | TEMPERATURE WHEN MEASURED | FIT AT AV. SMIN | FIT RANGE AT SMIN (LOOSEST) | FIT RANGE AT SMIN (TIGHTEST) |
|---|---|---|---|---|
| PRE-RUN | 185.0°F PLANNED START | 0.018 (COMPRESSION) | -0.005 (CLEARANCE) | 0.036 (COMPRESSION) |
| POST-RUN | 199.0°F ACTUAL START | 0.019 (COMPRESSION) | -0.004 (CLEARANCE) | 0.037 (COMPRESSION) |

DIFFERENCE BETWEEN PLANNED & ACTUAL START RUN FIT 0.001

CALCULATED FIT AT END OF RUN

| MEASUREMENTS TAKEN | TEMPERATURE WHEN MEASURED | FIT AT AV. SMIN | FIT RANGE AT SMIN (LOOSEST) | FIT RANGE AT SMIN (TIGHTEST) |
|---|---|---|---|---|
| PRE-RUN | 212.0°F PLANNED END | 0.022 (COMPRESSION) | -0.001 (CLEARANCE) | 0.040 (COMPRESSION) |
| POST-RUN | 225.0°F ACTUAL END | 0.022 (COMPRESSION) | 0.001 (COMPRESSION) | 0.042 (COMPRESSION) |

DIFFERENCE BETWEEN PLANNED & ACTUAL END RUN FIT 0.000

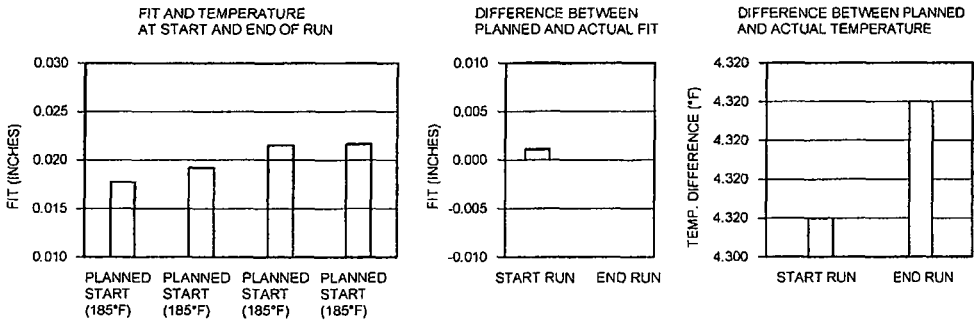

ROTOR / STATOR SIZE & FIT EVALUATION

START RUN:
THERE WAS A +5.6°c (10.0°F) DIFFERENCE BETWEEN THE PLANNED START RUN TEMPERATURE OF 85.0Ø (185.0°F) AND THE ACTUAL START RUN TEMPERATURE 90.6°C (196.0F) . THIS RESULTED IN A +0.001" DIFERENCE BETWEEN THE PLANNED START RUN FIT OF 0.018" AND THE ACTUAL START RUN FIT OF 0.019". BOTH PLANNED AND ACTUAL START RUN FITS WERE CALCULATED USING PRE-RUN SIZES. TEMPERATURE EFFECT ON STATOR ELASTOMER CAUSED A -0.038" CHANGE IN STATOR MINOR SIZE FROM SURFACE. (PRE-RUN SIZE AT PRE-RUN AMBIENT SURFACE TEMPERATURE OF 3.734" COMPARED WITH PRE-RUN SIZE ADJUSTED TO ACTUAL START RUN TEMPERATURE OF 3.696")

END RUN:
THERE WAS A +7.2°C (13.0°F) DIFFERENCE BETWEEN THE PLANNED END RUN TEMPERATURE OF 100.0°C (212.0°F) AND THE ACTUAL END RUN TEMPERATURE 107.2°C (225.0F) . THERE WAS NO DIFERENCE BETWEEN THE PLANNED START RUN FIT OF 0.022" AND THE ACTUAL START RUN FIT OF 0.022". THE ACTUAL START RUN FITS WERE CALCULATED USING PROST-RUN SIZES AT ACTUAL END RUN TEMP. THERE WAS AN EFFECTIVE 0.007" CHANGE IN STATOR SMIN SIZE OVER THE MOTOR RUN. (PRE-RUN SIZE ADJUSTED TO ACTUAL START RUN TEMPERATURE OF 3.669" COMPARED WITH POST RUN SIZE ADJUSTED TO ACTUAL END RUN TEMPERATURE OF 3.696")

ACTUAL END RUN FIT:
THE ACTUAL END RUN FIT OF 0.022" WAS AFFECTED BY THE FOLLOWING FACTORS:
TEMPERATURE EFFECT ON STATOR ELASTOMER CAUSED A -0.048" CHANGE IN STATOR SMINOR SIZE. (POST-RUN SIZE ADJUSTED TO PRE-RUN AMBIENT SURFACE TEMPERATURE OF 3.737" COMPARED WITH POST-RUN SIZE ADJUSTED TO ACTUAL END RUN TEMPERATURE OF 3.689")

STATOR SMINOR SIZE CHANGE OF +0.003" (PRE-RUN SIZE 3.734" AND POST-RUN SIZE 3.3.737" CORRECTED TO PRE-RUN AMBIENT TEMP.)

ROTOR RMAJOR SIZE CHANGE OF -0.002" (PRE-RUN SIZE 4.311" AND POST-RUN SIZE 4.309")

CONSEQUENTLY. THE MOST DOMINANT EFFECT ON THE ACTUAL END RUN FIT WAS THE TEMPERATURE EFFECT ON STATOR SMINOR SIZE. STATOR SIZE CHANGE HAVING A LESSER EFFECT AND ROTOR RMAJOR SIZE CHANGE HAVING THE LEAST EFFECT.

NOTES:
THERE WAS AN INCREASE OF 16.6°C (30.0°F) FROM THE ACTUAL START RUN TEMPERATURE OF 90.6°C (195.0°F) TO THE ACTUAL END RUN TEMPERATURE OF 107.2°C (225.0°F). THIS COMPARES WITH A PLANNED INCREASE OF 15.0°C (27.0°F) BETWEEN THE PLANNED START RUN OF 85.0°C (185.0°F) AND THE PLANNED END RUN TEMPERATURE OF 100.0°C (212.0°F).

*Fig. 11*

MONITOR AND CONTROL OF DIRECTIONAL DRILLING OPERATIONS AND SIMULATIONS

TECHNICAL FIELD

The application relates generally to downhole drilling. In particular, the application relates to a monitoring and control of directional drilling operations and simulations.

BACKGROUND

Directional drilling operations typically allow for greater recovery of hydrocarbons from reservoirs downhole.

BRIEF DESCRIPTION OF THE DRAWINGS

Embodiments of the invention may be best understood by referring to the following description and accompanying drawings which illustrate such embodiments. In the drawings:

FIG. 9 illustrates a report generated for a directional drilling operation/simulation, according to some embodiments of the invention.

FIGS. 10-11 illustrate another set of reports for a directional drilling operation/simulation, according to some embodiments of the invention.

DETAILED DESCRIPTION

Figure 1:
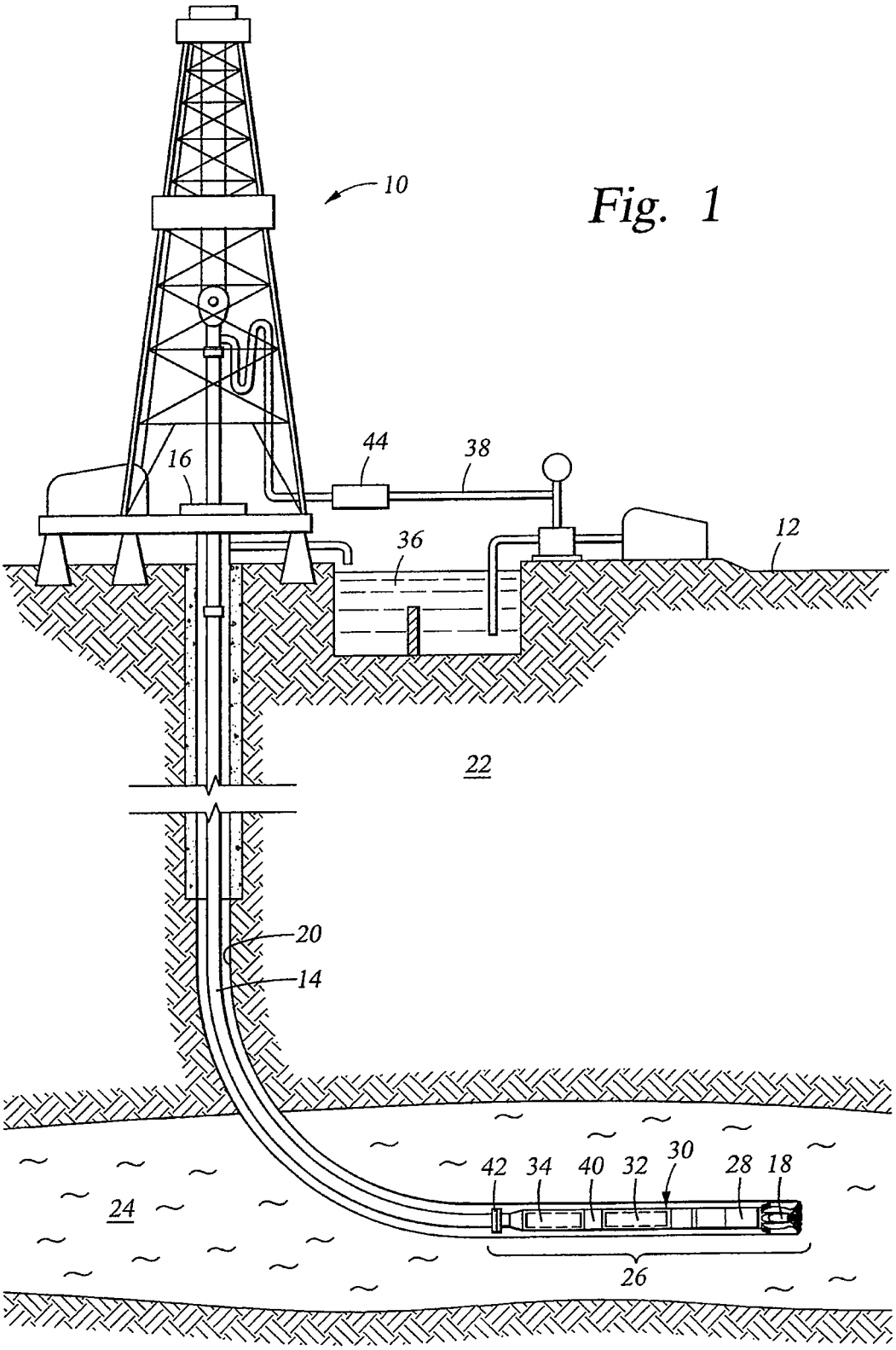
FIG. 1 illustrates a system for drilling operations, according to some embodiments of the invention.

Methods, apparatus and systems for monitor and control of directional drilling operations/simulations are described. In the following description, numerous specific details are set forth. However, it is understood that embodiments of the invention may be practiced without these specific details. In other instances, well-known circuits, structures and techniques have not been shown in detail in order not to obscure the understanding of this description.

This description of the embodiments is divided into five sections. The first section describes a system operating environment. The second section describes a computer operating environment. The third section describes graphical and numerical representations for a directional drilling operation/simulation. The fourth section describes load monitoring among downhole components. The fifth section provides some general comments.

Embodiments allow for monitoring and controlling of directional drilling operations and simulations. Embodiments may include graphical and numerical output of data received and processed from different sensors (including those at the surface and downhole). A 'rotary' drilling bottom hole assembly (BHA), downhole drilling motor, drilling turbine or downhole drilling tool such as a rotary steerable tool allows for directional drilling. The functioning of a BHA, downhole drilling motor, drilling turbine or rotary steerable tool in the dynamic downhole environment of an oilwell is relatively complex since operating parameters applied at surface (such as flow rate, weight on bit and drill string rotation rate) are combined with other characteristics of the downhole drilling operation. These other characteristics include formation characteristics (such as rock strength and geothermal temperature), characteristics of additional tools that are incorporated in the BHA (such as the drill bit), characteristics of the drilling fluids (such as lubricity), etc.

The application of sub-optimal operating parameters, excessive operating parameters and the undertaking of inappropriate actions during specific functional occurrences during motor operations downhole, are some of the problems that are encountered during a directional drilling operation.

Design engineers, support engineers, marketing personnel, repair and maintenance personnel and various members of a customer's personnel may never be present on a rig floor. Also there can be an effective disconnection between the directional driller on the rig floor and a functioning BHA, downhole drilling motor, drilling turbine or rotary steerable tool, thousands of feet below surface. Therefore, such persons do not have an accurate appreciation of the effect that surface applied operating parameters and the downhole operating environment can have on a drilling motor, drilling turbine or a rotary steerable tool as the motor/tool functions downhole.

Using some embodiments, operations personnel, design engineers, support engineers, marketing personnel, repair and maintenance personnel and customers can potentially add to their understanding of BHAs, downhole drilling motors, drilling turbines and rotary steerable tools in terms of the rig floor applied operating parameters and the resulting loads that they produce on motors/tools, which ultimately affect motor/tool performance. A more advanced understanding of the functioning of BHAs, downhole drilling motors, drilling turbines or rotary steerable tools by personnel from various disciplines would produce benefits form the design phase through to the post-operational problem investigation and analysis phase.

Embodiments would allow users to effectively train on a simulator through the control of the BHA, downhole drilling motor, drilling turbine or rotary steerable tool operations while avoiding the cost and potential safety training issues normally associated with rigsite and dynamometer testing operations. Embodiments would encourage a better understanding of the balance of motor/tool input and output with respect to the characteristics of the downhole operating environment and also with respect to motor/tool efficiency, reliability and longevity.

Some embodiments provide a graphical user interface (GUI) for monitoring a directional drilling operation. Some embodiments may be used in an actual drilling operation. Alternatively or in addition, some embodiments may be used in a simulation for training of operators for directional drilling. Data from sensors at the surface and downhole may be processed. A graphical and numerical representation of the operations downhole may be provided based on the processed data. Some embodiments may illustrate the performance of the BHA, downhole drilling motor, drilling turbine and rotary steerable tool used in directional drilling operations. Some embodiments may graphically illustrate the rotations per minute (RPMs) of and the torque applied by the downhole motor, drilling turbine or rotary steerable tool, the operating differential pressure across the motor, turbine, tool, etc. A cross-sectional view of the motor, turbine, tool within the drill string may be graphically shown. This view may show the rotations of the drill string in combination with the motor, turbine, and tool. Accordingly, the driller may visually track the speed of rotation of the drilling motor/rotary steerable tool and adjust if necessary. The following description and accompanying figures describe the monitoring and control of a drilling motor. Such description is also applicable to various types of rotary BHA's, drilling turbines and rotary steerable tools.

System Operating Environment

FIG. 1 illustrates a system for drilling operations, according to some embodiments of the invention. FIG. 1 illustrates a directional drilling operation. The drilling system comprises a drilling rig 10 at the surface 12, supporting a drill string 14. In some embodiments, the drill string 14 is an assembly of drill pipe sections which are connected end-to-end through a work platform 16. In alternative embodiments, the drill string comprises coiled tubing rather than individual drill pipes. A drill bit 18 couples to the lower end of the drill string 14, and through drilling operations the bit 18 creates a borehole 20 through earth formations 22 and 24. The drill string 14 has on its lower end a bottom hole (BHA) assembly 26 which comprises the drill bit 18, a logging tool 30 built into collar section 32, directional sensors located in a non-magnetic instrument sub 34, a downhole controller 40, a telemetry transmitter 42, and in some embodiments a downhole motor/rotary steerable tool 28.

Drilling fluid is pumped from a pit 36 at the surface through the line 38, into the drill string 14 and to the drill bit 18. After flowing out through the face of the drill bit 18, the drilling fluid rises back to the surface through the annular area between the drillstring 14 the borehole 20. At the surface the drilling fluid is collected and returned to the pit 36 for filtering. The drilling fluid is used to lubricate and cool the drill bit 18 and to remove cuttings from the borehole 20.

The downhole controller 40 controls the operation of telemetry transmitter 42 and orchestrates the operation of downhole components. The controller processes data received from the logging tool 30 and/or sensors in the instrument sub 34 and produces encoded signals for transmission to the surface via the telemetry transmitter 42. In some embodiments telemetry is in the form of mud pulses within the drill string 14, and which mud pulses are detected at the surface by a mud pulse receiver 44. Other telemetry systems may be equivalently used (e.g., acoustic telemetry along the drill string, wired drill pipe, etc.). In addition to the downhole sensors, the system may include a number of sensors at the surface of the rig floor to monitor different operations (e.g., rotation rate of the drill string, mud flow rate, etc.).

Computer Operating Environment

In some embodiments, the data from the downhole and the surface sensors is processed for display (as further described below). The processor components that process such data may be downhole and/or at the surface. For example, one or more processors in a downhole tool may process the downhole data. Alternatively or in addition, one or more processors either at the rig site and/or at a remote location may process the data. Moreover, the processed data may then be numerically and graphically displayed (as further described below).

Figure 2:
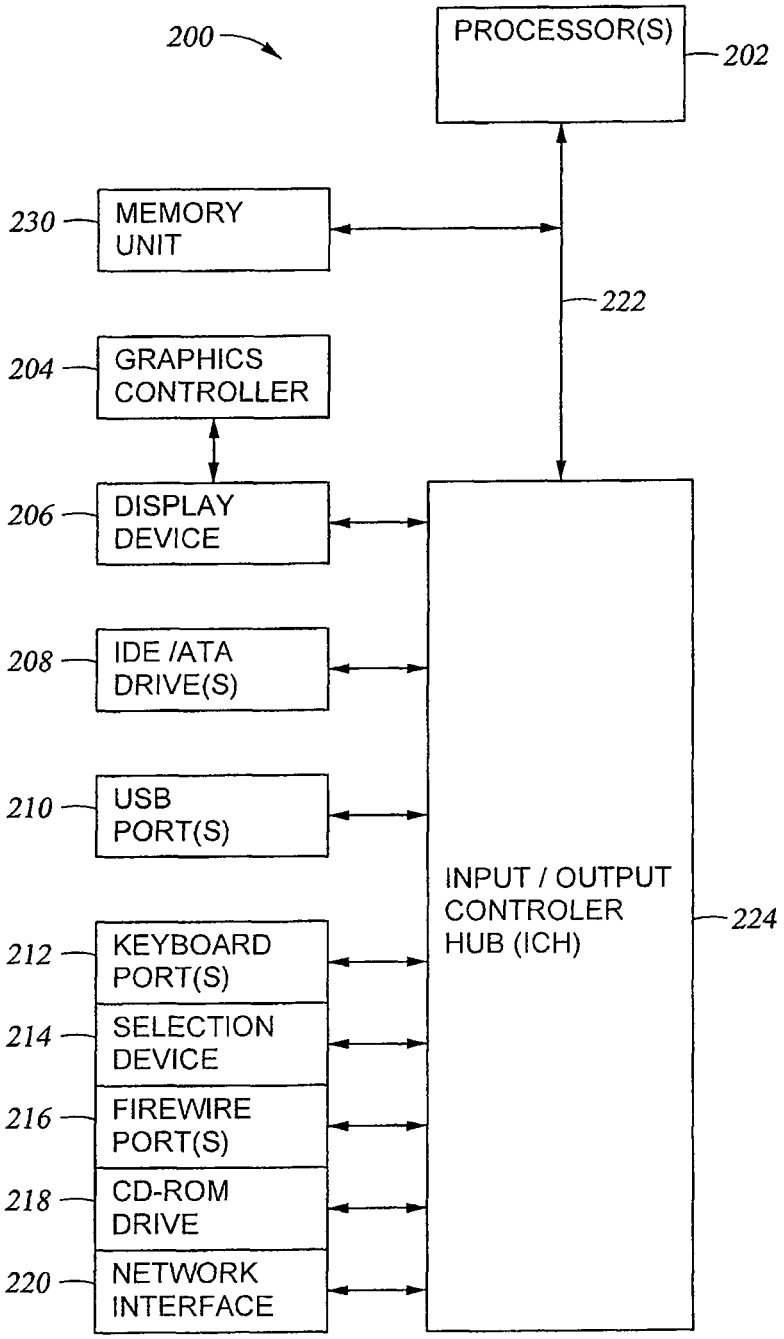
FIG. 2 illustrates a computer that executes software for performing operations, according to some embodiments of the invention.

An example computer system, which may be used to process and/or display the data is now described. In particular, FIG. 2 illustrates a computer that executes software for performing operations, according to some embodiments of the invention. The computer system 200 may be representative of various components in the system 200. For example, the computer system 200 may be representative of parts of the downhole tool, a computer local to the rig site, a computer remote to the rig site, etc.

As illustrated in FIG. 2, the computer system 200 comprises processor(s) 202. The computer system 200 also includes a memory unit 230, processor bus 222, and Input/Output controller hub (ICH) 224. The processor(s) 202, memory unit 230, and ICH 224 are coupled to the processor bus 222. The processor(s) 202 may comprise any suitable processor architecture. The computer system 200 may comprise one, two, three, or more processors, any of which may execute a set of instructions in accordance with embodiments of the invention.

The memory unit 230 may store data and/or instructions, and may comprise any suitable memory, such as a dynamic random access memory (DRAM). The computer system 200 also includes IDE drive(s) 208 and/or other suitable storage devices. A graphics controller 204 controls the display of information on a display device 206, according to some embodiments of the invention.

The input/output controller hub (ICH) 224 provides an interface to I/O devices or peripheral components for the computer system 200. The ICH 224 may comprise any suitable interface controller to provide for any suitable communication link to the processor(s) 202, memory unit 230 and/or to any suitable device or component in communication with the ICH 224. For one embodiment of the invention, the ICH 224 provides suitable arbitration and buffering for each interface.

For some embodiments of the invention, the ICH 224 provides an interface to one or more suitable integrated drive electronics (IDE) drives 208, such as a hard disk drive (HDD) or compact disc read only memory (CD ROM) drive, or to suitable universal serial bus (USB) devices through one or more USB ports 210. For one embodiment, the ICH 224 also provides an interface to a keyboard 212, a mouse 214, a CD-ROM drive 218, one or more suitable devices through one or more firewire ports 216. For one embodiment of the invention, the ICH 224 also provides a network interface 220 though which the computer system 200 can communicate with other computers and/or devices.

In some embodiments, the computer system 200 includes a machine-readable medium that stores a set of instructions (e.g., software) embodying any one, or all, of the methodologies for described herein. Furthermore, software may reside, completely or at least partially, within memory unit 230 and/or within the processor(s) 202.

Graphical and Numerical Representations for Directional Drilling Operation/Simulation Directional drilling is based on decisions being made by the directional driller which are the result of information being made available to the driller at the rig floor, in logging units at the rig site (not at the rig floor), and on the directional driller's conceptions about equipment performance and functioning. The decisions made by the directional driller have a direct bearing on the drilling operating parameters applied at surface to drilling tools downhole. Embodiments provide for real time representation of comprehensive directional drilling data at rig floor (on an intrinsically safe computer or purged driller's control unit or "dog house"), at rig site (data logging unit or office) and remotely (office or dedicated Remote Technical Operations (RTO) Center of the directional drilling supplier and/or oil company).

An important part of the directional drilling process is the interaction of the drill bit with the formation in terms of the torque and RPM applied to the drill bit and the loading imparted into the formation to locally fail and remove the formation. Another important part is how the torque and RPM applied at the drill bit causes reactive mechanical loadings in the bottom hole drilling assembly tools which affect the trajectory of the hole drilled.

Maintaining a consistent level of torque and revolutions on the drill bit may achieve and maintain good formation penetration rate, good hole directional control, etc. Moreover, this consistent level allows the maximization of the reliability and longevity of various downhole drilling tools in the bottom hole drilling assembly (fluctuating mechanical and pressure loadings accelerate the wear and fatigue of components).

While drilling, the drill bit has a number of sources of excitation and loading. These sources may cause the bit speed to fluctuate, the bit to vibrate, the bit to be excessively forced into the formation, and in some cases the bit to actually bounce off the hole bottom. The application of weight to the bit (by slacking off the rig hook load) may be a source of excitation and loading. There can be a number of these sources, which can negatively affect the face of the drill bit and formation interaction. For example, some of the weight applied at surface at times is not transmitted to the drill bit because the drillstring and bottom hole assembly contact the casing and hole wall causing substantial frictional losses. The drill string can then suddenly "free-off" resulting in remaining, previously hung-up weight, being abruptly transferred to the drill bit with resulting heavy reaction loadings being applied to the tools (internals and housings) in the bottom hole drilling assembly. Another example of such a source relates to the application of torque at the surface. At times, not all of the torque is transmitted to the drill bit. The drill string may be subsequently freed, such that high torsional loadings may be abruptly applied to tools in the bottom hole drilling assembly.

Another example of sources of excitation and loading relate to floating semi-submersible drilling rigs and drillships. In such operations, the consistent application of weight to the bit is undertaken via the use of wave heave compensators. However, these compensators can often not be 100% effective and harsh weather can also exceed their capability. Weight applied at the bit fluctuates significantly, which can cause great difficulty when undertaking more precise directional control drilling operations. In some cases the bit can actually lift off bottom.

The above scenarios are often not observable at surface by the directional driller. Embodiments may process relevant data. Through graphic and numerical representation, embodiments may indicate fluctuations in the drill bit rotation and in drilling motor/rotary steerable tool output torque and RPM characteristics. The grouped presentation of this data has not been previously available to the live rig floor directional drilling process. Embodiments also allow such events to be considered in detail from recorded well data and contingencies to be established. Some embodiments are applicable to rotary drilling assemblies where there is no drilling motor in the bottom hole drilling assembly, such as rotary steerable drilling assemblies.

Until now the data which is available in relation to the directional drilling process has not been available to the directional driller in real time in one location. Moreover, conventional techniques have required a significant level of conception by the directional driller and ideally have included interpretation and input by specialists other than the directional driller who are not present on the rig floor. As the electronic instrumentation of downhole drilling tools continues to develop, ever increasing amounts of data are becoming available from downhole on which the directional drilling process can be made more efficient and effective.

Embodiments provide a central platform on which to display dynamic numerical and graphical data together. In addition to displaying data generated by sensors contained within downhole tools, embodiments may provide a platform where alongside sensor data, very recently developed and further developing cutting-edge directional drilling engineering modeling data, can be jointly displayed. Moreover, embodiments may interpret and provide a dynamic indication of occurrences downhole that have to date otherwise gone unnoticed live at the rig floor by the directional driller (e.g. drilling motor/rotary steerable tool micro-stalling, downhole vibration, and drill bit stick-slip, etc.).

Embodiments may also process data and display to the directional driller the level of loading being applied to downhole tools in terms of overall efficiency of the drilling system, mechanical loadings such as fatigue tendencies and estimated reliability of specific downhole tools. This in effect provides the directional driller with a far more comprehensive picture and understanding of the complete directional drilling process based on dynamic numerical data (sensors and modeled data), dynamic graphics, and estimations or look-aheads in terms of equipment reliability (based on empirical knowledge, dynamometer testing data and engineering design data). The data may be obtained direct from surface and downhole sensors and from modeled data based on sensor data inputs processed by the embodiments. The processing may be based on data obtained from dynamometer testing, and via drilling industry and classic engineering theory. Embodiments provide dynamic graphics and digital estimations or look-aheads in terms of both the directional drilling behavior of the downhole drilling assembly and downhole drilling equipment reliability.

An important component to many directional drilling applications is the optimum application of downhole drilling motors and rotary steerable tools. Embodiments may provide dynamic graphical and numerical representations of drilling motors and rotary steerable tools in operation in terms of the differential operating pressure across motors and loadings applied by the drill string to rotary steerable tools. Furthermore, embodiments may provide dynamic drilling motor/rotary steerable tool input/output performance graphs, to aid the directional driller's perception and decision making.

Embodiments allow for real time representation of drilling motor/rotary steerable tool operating differential pressure for the directional drilling operation. Conventionally, the directional driller had to reference an off-bottom standpipe pressure value at rig floor in relation to the dynamic on-bottom pressure value at rig floor. The driller could then deduce the resulting pressure differential and conceive the result of this in terms of motor/tool output torque and motor/tool RPM (as applied to the bit). Embodiments show these pressure differentials and resulting torque and RPM values both through a dynamic performance graph and a numerical representation. In some embodiments, the real time representations (as described) may be displayed local as well as remote relative to the rig site.

Some embodiments may allow for simulation of a directional downhole drilling operation. Some embodiments offer an aid to the understanding of the functioning of a downhole drilling motor/rotary steerable tool by allowing the simulator operator to see and control the results of their applied motor/tool operating parameters real-time. The simulator operator may choose from various types of drilling conditions, may control Weight On Bit (WOB), flow rate, drillstring rotation rate. Moreover, the operator may simultaneously see the resulting differential pressure across the motor/tool.

The simulator operator may see where the resultant motor or rotary steerable tool output torque and Rotations Per Minute (RPMs) figure on a performance graph for the motor/tool. In some embodiments, the simulator operator may also see an animated cross sectional graphic of the rotor rotate/precess in the stator and may see the stator rotate due to the application of drillstring rotation (at 1:1 speed ratio or scaled down in speed for ease of viewing). The operator can also see motor/tool stalling, may get a feel for how much load is induced in the motor/tool, may see simulated elastomer heating and chunking, and may be given an indication of what effect this has on overall motor/tool reliability.

Some embodiments allow the operator to select optimum drilling parameters and objectives for particular drilling conditions and to tune the process to provide an efficient balanced working system of inputs versus outputs. In some embodiments, once that control has been achieved and held, the system may project what the real life outcome should be in terms of a sub-50 hr run or in excess of 50, 100, 150, or 200 hr runs. Using some embodiments, simulator operators are encouraged to understand that high Rate Of Penetration (ROP) and operations at high motor or rotary steerable tool loadings are to be considered against potential toolface control/stall occurrence issues and corresponding reduced reliability and longevity issues.

In some embodiments, problem scenarios may be generated by the system and questions asked of the operator regarding the problem scenarios in terms of weighing up the problem indications against footage/time left to drill, drilling conditions, etc., in the particular application. Problem scenarios that are presented in relevant sections of a technical handbook may be referenced via hypertext links (i.e. the operator causes a motor/tool stall and they get linked to the items about 'stall' in the handbook).

In some embodiments, the simulator may include a competitive user mode. For the 'competitive user' mode there is a scoring system option and ranking table for sessions. Different objective settings could be selected (i.e. drill a pre-set footage as efficiently/reliably as possible, or drill an unlimited footage until predicted tool problems or reduced tool wear/efficiency/reliability cause operations to be stopped). A score may be obtained which may be linked to one or more of a number of parameters. The parameters may include the following:

- chosen operating settings given the drilling situation selected by the user
- maintaining operating parameters such that reliability of the motor/tool is ensured, etc.
- ROP/footage drilled
- the number of stall occurrences
- reactions to stall situations
- the reaction to various problem occurrences that occur
- overall process efficiency for the duration of the simulator session The simulator may allow for a number of inputs and outputs. With regard to inputs, the simulator may allow for a configuration of the following:

- size and type of motor or rotary steerable tool (e.g., outside diameter of the tool)
- size and type of tool (e.g., motor, rotary steerable tool, adjustable gauge stabilizer, etc.)
- stator elastomer type: high temperature/low temperature
  - rotor/stator mating fit at surface: compression/size for size/clearance high/low
  - rotor jet nozzle fitted? yes/no (allow user to go to calculator from handbook) size?
- motor bent housing angle setting
  - motor sleeve stabilizer gauge
  - string stabilizer gauge Other inputs for the simulator may include the following:

- General Formation Type say 1 to 5 (soft to hard formation)
- Stringers In Formation?: Yes/No
- Bit Type: Rollercone/PDC/Diamond
- Bit Diameter
- Bit Gauge
- Bit Manufacturers Details/Serial Number
- Bit Aggression Rating:
- Bit Jets: number/sizes
- Mud Type: Oil Base, Water Base, Pseudo Oil Base Other inputs for the simulator may also include the following:

- Max WOB
- Min/Max Flow Rate
- Max String Rotation Rate
- Minimum Acceptable ROP
- Maximum ROP
- Maximum Operating Differential Pressure
- Maximum Reactive Torque From Motor/Tool
- Downhole Operating Temperature
- Temperature At Surface
- Axial Vibration Level
- Lateral Vibration Level
- Torsional Vibration Level Some real time operator control inputs may include the following:

- Drilling Mud Flow Rate (GPM)
- Drillstring Rotation Rate (RPM)
- Weight On Bit (KLbs)
- Azimuth
- Inclination In some embodiments, the simulator may allow for different graphical and numerical outputs, which may include the following:

Motor/Tool RPM/Torque/Horsepower performance graph with moving cross hairs applied (performance graph indicating entry into the transition zone and stall zone)
Animated cross sectional view of power unit rotor/stator showing rotor rotation and precession
Motor/Tool operating differential pressure gauge indicating entry into the transition zone and stall zone
Possible animated longitudinal cross section view of the power unit rotor/stator which shows the drilling mud going between the rotor and stator (rotor rotating and fluid cavities moving), (may also include a view of the full motor/tool i.e. show fluid flow over the transmission unit and through the driveshaft/bearing assembly).
Drillstring RPM, mud pump GPM and WOB controllers
Motor/Tool output RPM and output torque
Actual bit RPM (drillstring RPM+motor/tool output RPM, allowing for motor/tool volumetric inefficiency etc)
Actual, minimum, maximum and average ROP indicators
Overall efficiency/reliability indicator
Stall occurrence indicator
Current and overall response to events indicator (program puts up items such a full or micro-stall, stringers, bit balling etc)
Various warning alarm noises incorporated Other graphical and numerical outputs may include the following:

Rotor/Stator Fit Change Due To Downhole Temperature
Elastomer temperature indicator
stator temperature/damage tendency (alarm on cracking, tearing, chunking)
Cumulative footage drilled
for burst and overall ROP
reactive torque
the number of stalls indicator (micro and full)
time for reactions to stall situations
the overall process efficiency for the duration of the simulator session/tie into reliability indicator In some embodiments, other graphical and numerical outputs may include the following:

Maximum WOB
Minimum/Maximum Flow Rate
Bit Whirl Outputs
Axial Vibration Level
Lateral Vibration Level
Torsional Vibration Level In some embodiments, other graphical and numerical outputs may include the following:

Real-time rotor/stator cross sectional animation
Analogue type standpipe pressure gauge animation
Interactive user controls: GPM, WOB, drillstring rotation rate
Stall Indicator, Micro Stall Indicator
User Screen Indicators:
WOB
Flow rate (minimum/maximum)
String RPM (maximum)
Motor/tool differential pressure
Motor/tool torque
Motor/tool output RPM
Actual bit RPM (string and motor)
Micro-stall occurrences
Full stall occurrences
Min acceptable ROP
Cumulative footage drilled
Elapsed time
Actual and Average ROP
Overall efficiency/reliability level, rating
Stator damage tendency
Formation (Basic)
General formation drillability type, i.e. 1 to 5 (easy to hard drilling)

In some embodiments, other graphical and numerical outputs may include some advanced outputs, which may include the following:

Rotor/Stator Fit Change Due To Downhole Temperature
Elastomer temperature indicator
stator temperature/damage tendency (alarm on cracking, tearing, chunking)
Cumulative footage drilled
for burst and overall ROP
reactive torque
the number of stalls indicator (micro and full)

In some embodiments, the interface may include a tally book. The tally book may display real-time recording of data and notes. The tally book may be an editable document that may be accessible for download for future reference. In some embodiments, the data that is displayed may be recorded and graphically replayed. Accordingly, drilling tool problem occurrences may be analyzed and displayed to customers.

Some embodiments may be used for both actual and simulated drilling operations for different modes including a motor Bottom Hole Assembly (BHA) and BHA with drilling motor and tools above and below (e.g. underreamer and rotary steerable tool), etc.

Figure 3:
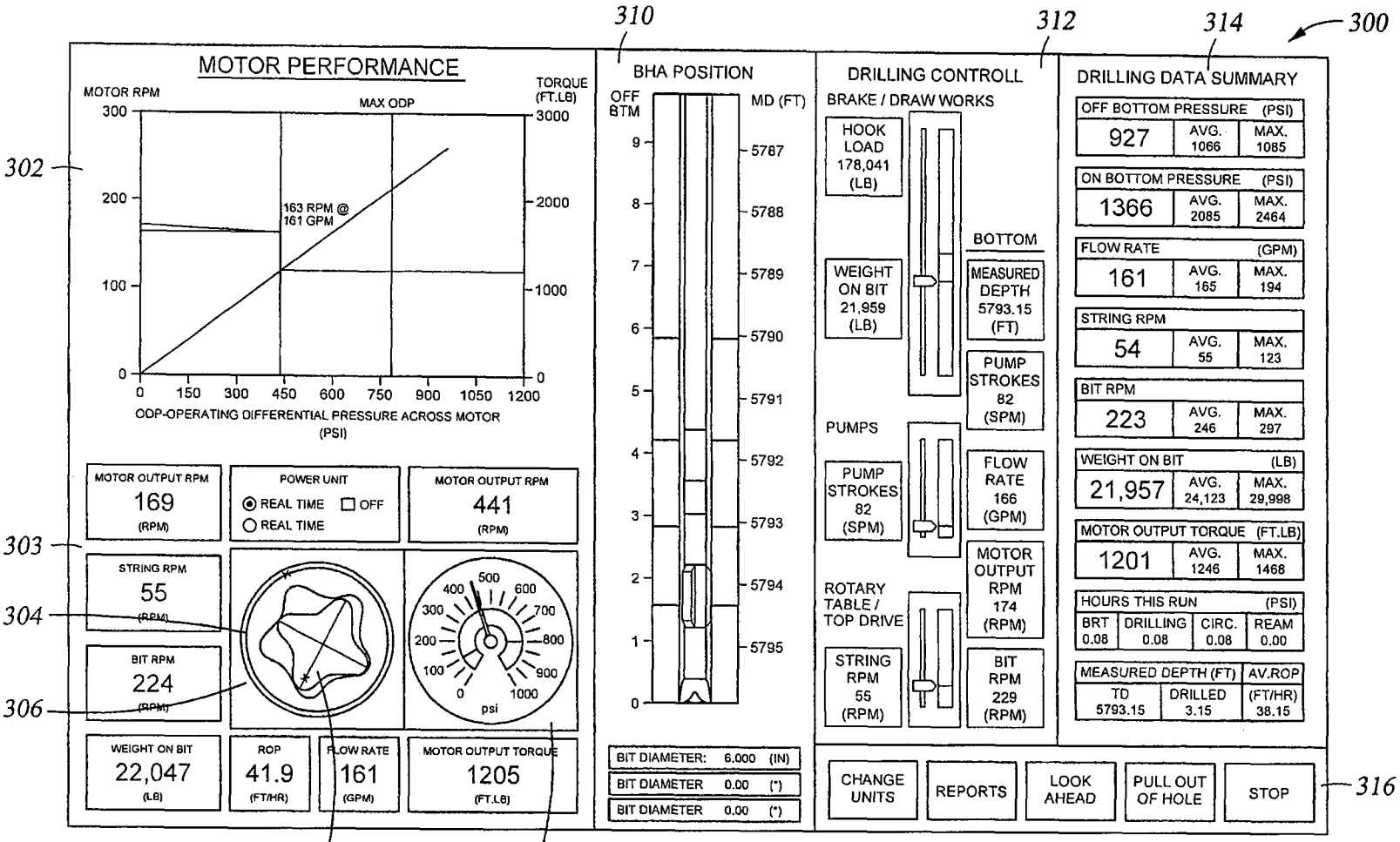
FIG. 3 illustrates a graphical user interface (GUI) screen that allows for controlling and monitoring of a directional drilling operation/simulation, according to some embodiments of the invention.

Various graphical user interface screens for display of graphical and numerical output for monitoring and controlling of a drilling operation/simulation are now described. FIG. 3 illustrates a graphical user interface (GUI) screen that allows for controlling and monitoring of a directional drilling operation/simulation, according to some embodiments of the invention. A GUI screen 300 includes a graph 302 that tracks the performance of the downhole motor. The graph 302 illustrates the relationship among the motor flow rate and RPM, the operating differential pressure across the downhole motor and the torque output from the downhole motor. A graphic 303 of the GUI screen 300 illustrates graphical and numerical data for the downhole drilling motor. A graphic 304 illustrates a cross-section of a drill string 306 that houses a downhole motor 308. The downhole motor 308 may include a positive displacement type helically lobed rotor and stator power unit, where, for a given flow rate and circulating fluid properties, the operating differential pressure across the power unit is directly proportional to the torque produced by the power unit. As shown, the downhole motor 308 includes a number of lobes on a rotor that fit into a number of lobed openings in a stator housing 306. As the pressurized drilling fluid flows through the openings between the lobes, one or more of the lobes engage one or more of the openings, thereby enabling rotation. The graphic 304 may be updated based on sensors to illustrate the rotation of both the drill string 306 and the downhole motor 308. Accordingly, the drilling operator may visually track the rotation and adjust if necessary.

A graphic 305 illustrates a meter that tracks the differential pressure across the downhole drilling motor. The graphic 303 also includes numerical outputs for a number of attributes of the motor, drill bit and drill string. For example, the graphic 303 includes numerical outputs for the motor output RPMs, the drill string RPMs, the drill bit RPMs, the weight on bit, the power unit, the differential pressure, the rate of penetration, the flow rate and the motor output torque.

A graphic 310 of the GUI screen 300 illustrates the position of the BHA (including the depth in the borehole and the distance that the bit is from the bottom). A graphic 312 of the GUI screen 300 illustrates data related to drilling control (including brake/draw works, pumps and rotary table/top drive). A graphic 314 of the GUI screen 300 provides a drilling data summary (including off bottom pressure, on bottom pressure, flow rate, string RPM, bit RPM, weight on bit, motor output torque, hours for the current run, measured depth and average ROP).

A graphic 316 of the GUI screen 300 includes a number of buttons, which allows for the units to be changed, to generate reports from this drilling operation, to perform a look ahead for the drilling operation, to remove the drill string from the borehole and to stop the drilling operation/simulation.

Figure 4:
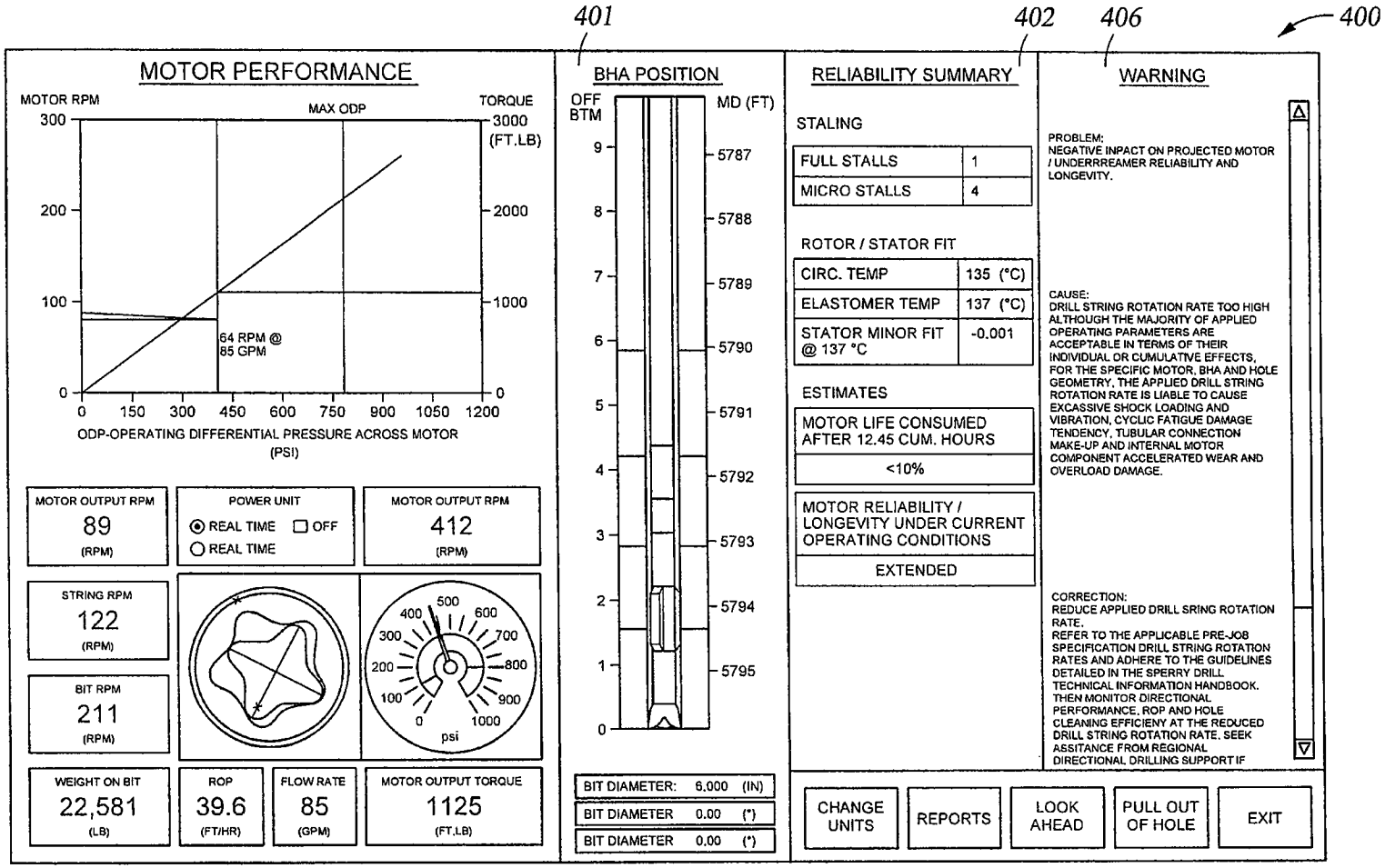
FIG. 4 illustrates a GUI screen that allows for controlling and monitoring of a directional drilling operation/simulation, according to some other embodiments of the invention.

FIG. 4 illustrates a graphical user interface (GUI) screen that allows for controlling and monitoring of a directional drilling operation/simulation, according to some other embodiments of the invention. A GUI screen 400 has some of the same graphics as the GUI screen 300. In addition, the GUI screen 400 includes some additional graphics.

The GUI screen 400 includes a graphic 401. The graphic 401 illustrates the position of the drill bit (including the depth in the borehole and the distance that the bit is from the bottom). The GUI screen 400 includes a graphic 402 that includes a summary of the reliability of the drilling operation (including data related to stalling, rotor/stator fit and estimates of reliability). The GUI screen 400 includes a graphic 406 that includes warnings of problems related to the drilling operation/simulation, causes of such problems and corrections of such problems.

Figure 5:
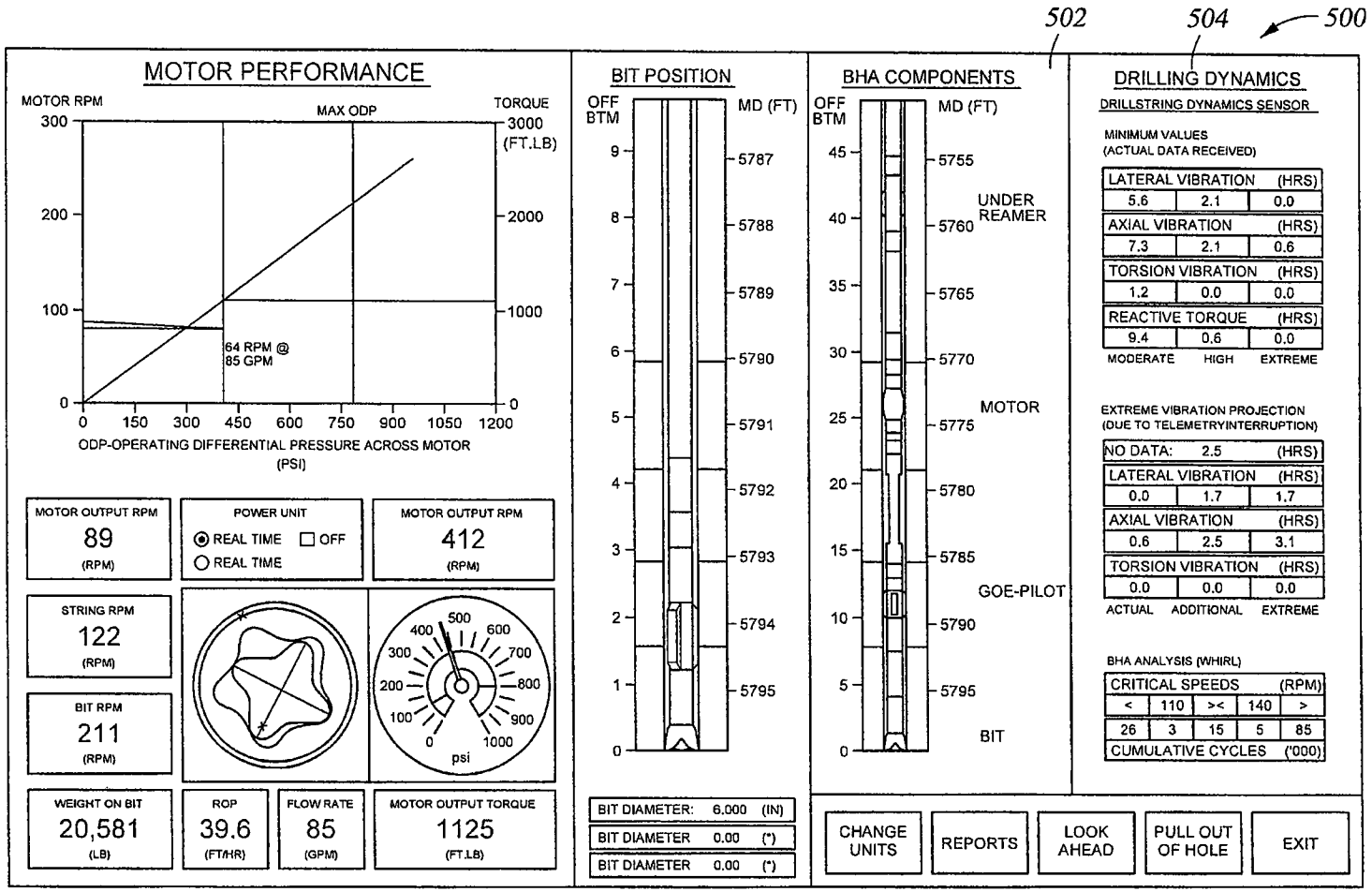
FIG. 5 illustrates a GUI screen that allows for controlling and monitoring of a directional drilling operation/simulation, according to some other embodiments of the invention.

FIG. 5 illustrates a graphical user interface (GUI) screen that allows for controlling and monitoring of a directional drilling operation/simulation, according to some other embodiments of the invention. A GUI screen 500 has some of the same graphics as the GUI screens 300 and 400. In addition, the GUI screen 500 includes some additional graphics.

The GUI screen 500 includes a graphic 502 that illustrates the positions of the different BHA components downhole. The BHA components illustrated include an under reamer, the downhole drilling motor and a rotary steerable tool. The graphic 502 illustrates the distance from the surface and from the bottom for these different BHA components. The GUI screen 500 also includes a graphic 504 that illustrates drilling dynamics of the drilling operation. The drilling dynamics include numerical outputs that include actual data for lateral vibration, axial vibration, torsional vibration and reactive torque. The drilling dynamics also include numerical outputs that include extreme vibration projection (including lateral, axial and torsional). The drilling dynamics also includes a BHA analysis for whirl, which tracks the speeds and cumulative cycles of the BHA.

Figure 6:
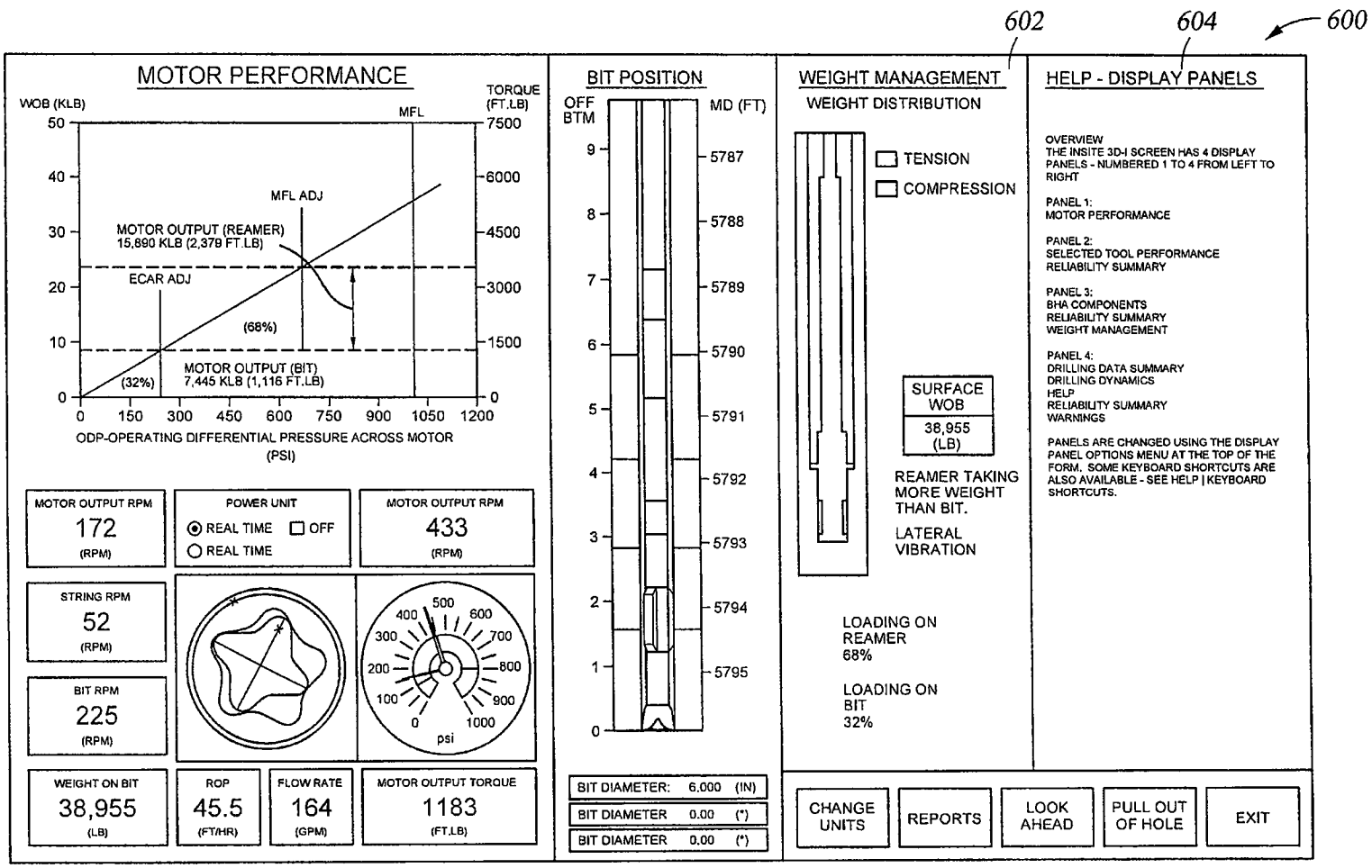
FIG. 6 illustrates a GUI screen that allows for controlling and monitoring of a directional drilling operation/simulation, according to some other embodiments of the invention.

FIG. 6 illustrates a graphical user interface (GUI) screen that allows for controlling and monitoring of a directional drilling operation/simulation, according to some other embodiments of the invention. A GUI screen 600 has some of the same graphics as the GUI screens 300, 400 and 500. In addition, the GUI screen 600 includes some additional graphics.

The GUI screen 600 includes a graphic 602 that illustrates weight management of different parts of the BHA. The graphic 602 includes the total weight on bit and the percentages of the weight on the reamer and the drill bit. The GUI screen 600 also includes a graphic 604 that includes help relative to the other graphics on the GUI screen 600.

Figure 7:
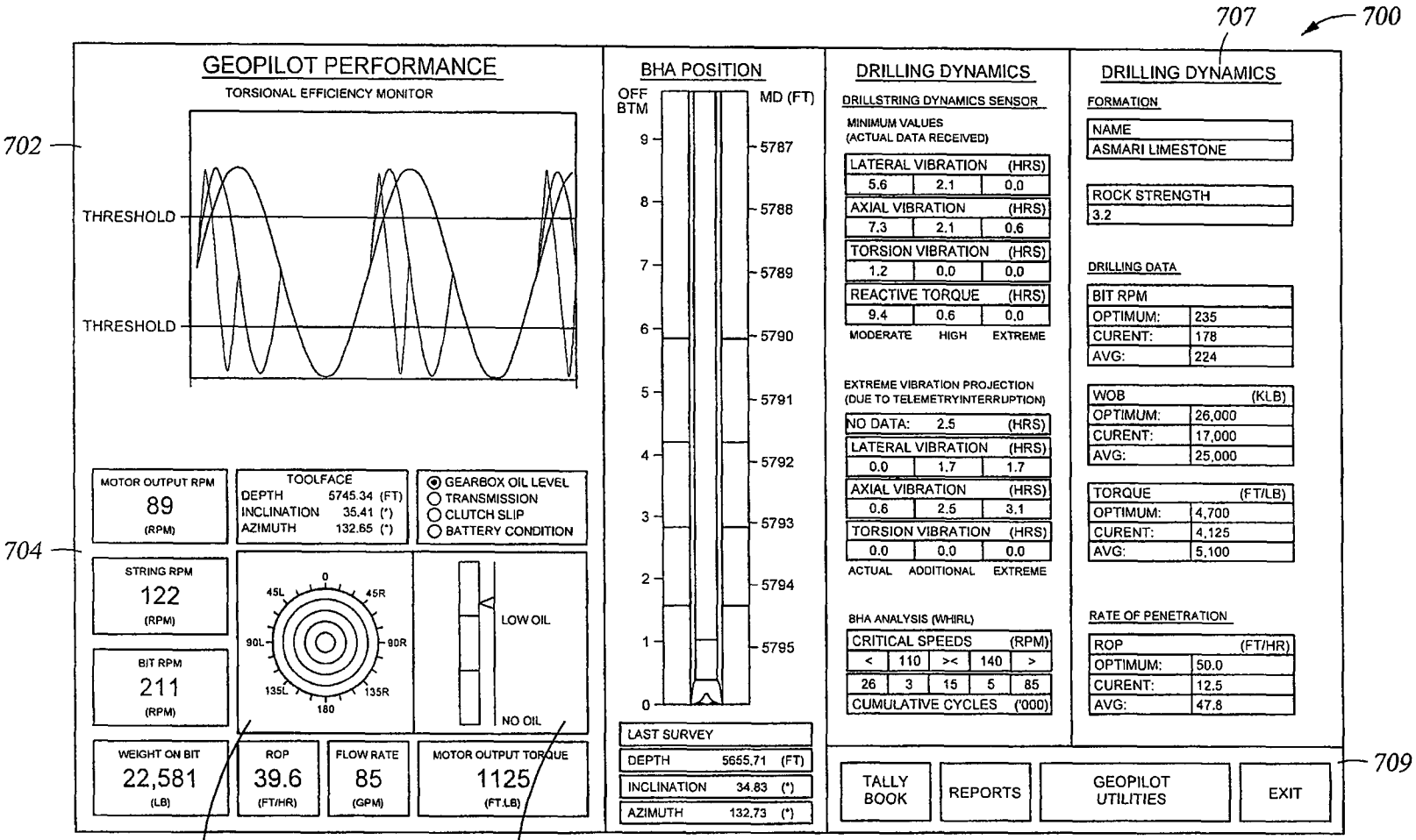
FIG. 7 illustrates a GUI screen that allows for controlling and monitoring of a directional drilling operation/simulation, according to some other embodiments of the invention.

FIG. 7 illustrates a graphical user interface (GUI) screen that allows for controlling and monitoring of a directional drilling operation/simulation, according to some other embodiments of the invention. A GUI screen 700 has some of the same graphics as the GUI screens 300, 400, 500 and 600. In addition, the GUI screen 700 includes some additional graphics.

The GUI screen 700 includes a graph 702 that illustrates the performance of a rotary steerable tool. In particular, the graph 702 monitors the torsional efficiency of the rotary steerable tool relative to a minimum threshold and a maximum threshold. The GUI screen 700 also includes a graphic 704. The graphic 704 includes a graphic 706 that illustrates the current toolface of the bottom hole assembly. The toolface is an azimuthal indication of the direction of the bottom hole drilling assembly with respect to magnetic north. The toolface is referenced to the planned azimuthal well direction at a given depth. The graphic 704 also includes a graphic 708 that illustrates a meter that monitors the gearbox oil level. This meter may be changed to monitor other tool parameters such as the transmission, the clutch slip and the battery condition.

The graphic 704 also includes numerical outputs for a number of attributes of the motor, drill bit and drill string. For example, the graphic 704 includes numerical outputs for the motor output RPMs, the drill string RPMs, the drill bit RPMs, the weight on bit, the rate of penetration, the flow rate and the motor output torque. The graphic 704 also includes numerical outputs for the depth, inclination and azimuth of the well bore.

The GUI screen 700 also includes a graphic 707 that summarizes the drilling efficiency. The graphic 707 includes a description of the formation being cut (including name and rock strength). The graphic 707 also includes numerical output regarding the optimum, current and average for the bit RPM, weight on bit and torque. The graphic 707 also includes a description of the predicate, current and average rate of penetration.

The GUI screen 700 includes a graphic 709 that includes a number of buttons. One button allows for a tallybook application to be opened to allow this data to be input therein. Another button allows for a report to be generated based on the data for this drilling operation. Another button allows for a display of the rotary steerable drilling tool utilities.

Figure 8:
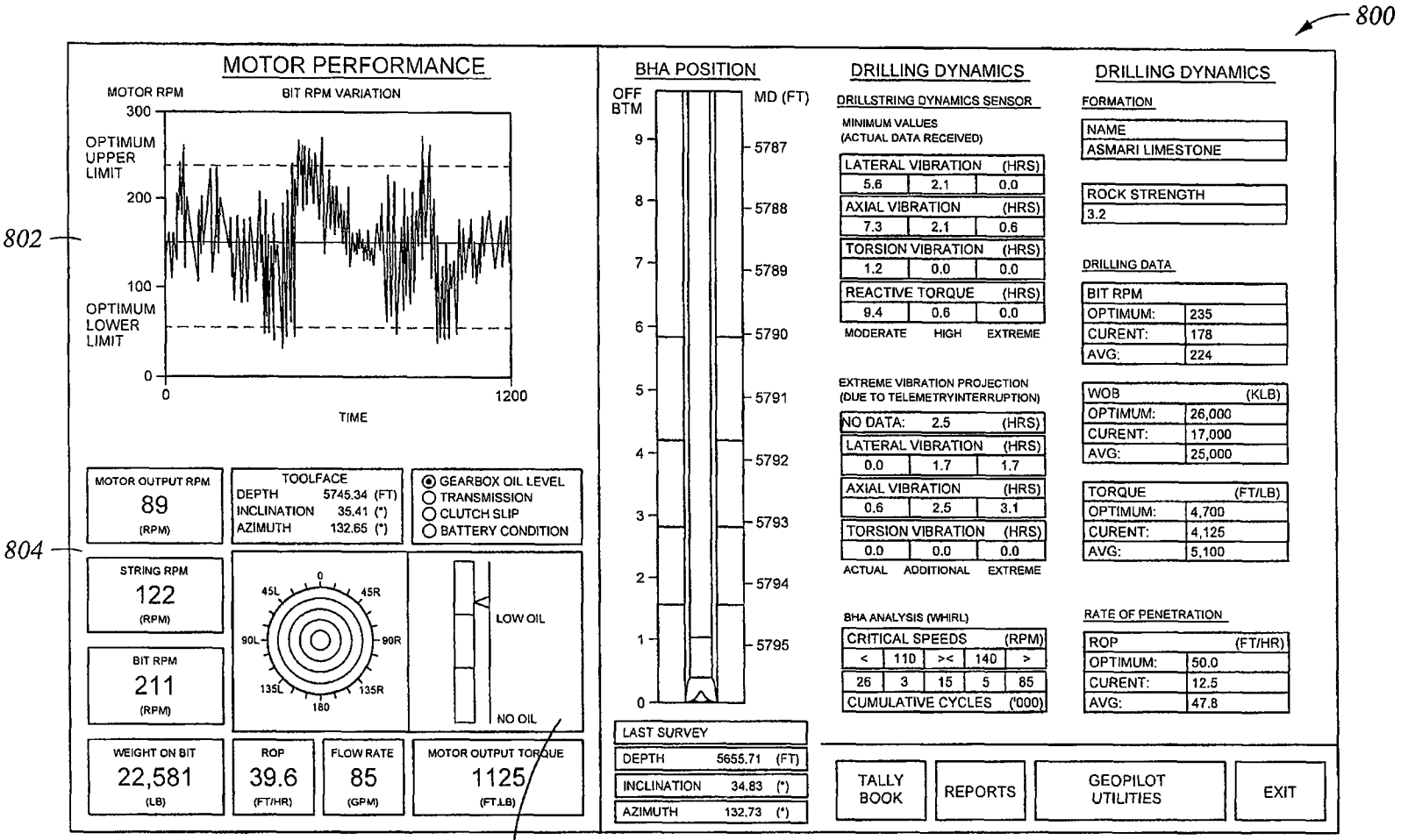
FIG. 8 illustrates a GUI screen that allows for controlling and monitoring of a directional drilling operation/simulation, according to some other embodiments of the invention.

FIG. 8 illustrates a graphical user interface (GUI) screen that allows for controlling and monitoring of a directional drilling operation/simulation, according to some other embodiments of the invention. A GUI screen 800 has some of the same graphics as the GUI screens 300, 400, 500, 600 and 700. In addition, the GUI screen 800 includes some additional graphics.

The GUI screen 800 includes a graph 802 that illustrates the bit RPM variation over time. The graph 802 includes an optimum upper limit and an optimum lower limit for this variation. The graphic 804 is similar to the graphic 704. However, the graphic 708 is replaced with a graphic 806, which includes an illustration of a meter for the current bit RPM. This meter may be changed to monitor the motor RPM, the drill string RPM, the weight on bit, cyclic bending stress (fatigue) loading on drilling assembly components, etc.

FIG. 9 illustrates a report generated for a directional drilling operation/simulation, according to some embodiments of the invention. A report 900 includes graphical and numerical outputs that include data for the drilling (such as depth, rate of penetration, flow rates, etc.). The report 900 also includes attributes for the motor, the drill bit and the mud (including model type, size, etc.). The report 900 includes a motor performance graph similar to graph 302 shown in FIG. 3. The report 900 may be generated at any point during the drilling operation/simulation.

FIGS. 10-11 illustrate another set of reports for a directional drilling operation/simulation, according to some embodiments of the invention. A report 1000 and a report 1100 provide graphical, numerical and text output regarding the operations of the downhole drilling motor. Embodiment may perform numerical logic routines and combine the results with specific written sentences from system memory into written reports. In so doing, embodiments may reduce the burden on the user to first evaluate numerical data and physical occurrences and then to produce grammatically and technically correct written reports. This advanced automated text based reporting facility is referred to within the embodiment as "pseudo text" and "pseudo reporting" and has not been available to the directional drilling process before. This facility is applicable to real-time drilling operations and post-drilling applications analysis.

While a number of different graphics have been shown across different GUI screens, embodiments are not limited to those illustrated. In particular, less or more graphics may be included in a particular GUI screen. The graphics described may be combined in any combination. Moreover, the different GUI screens are applicable to both real time drilling operations and simulations.

Load Monitoring Among Downhole Components

Some embodiments provide load monitoring among the downhole components (including the load distribution between the drill bit and reamers). In some embodiments, downhole drilling motors use a positive displacement type helically lobed rotor and stator power units where, for a given flow rate and circulating fluid properties, the operating differential pressure developed across the power unit is directly proportional to the torque produced by the power unit. The relationship between weight on bit (WOB) and differential pressure (AP) may be used in relation to assessing the torsional loading and rotation of drill bits—through correlation with the specific performance characteristics (performance graph) for the motor configuration (power unit) being used.

It is becoming increasingly common for operators to run hole opening devices, such as reamers, in conjunction with motors for significant hole enlargement operations of up to +30%. The configuration of these BHAs typically places 30 feet to 120 feet of drill collars, stabilizers and M/LWD equipment between the cutting structure of the bit and the cutting structure of the hole opening device or reamer. In layered formations it is common for the each cutting structure to be in a different rock type causing wide variation in the WOB applied to each cutting structure. The inability to monitor and correct the application of WOB vs. weight on reamer (WOR) has resulted in multiple catastrophic tool failures and significant non productive time (NPT) costs to operators and service providers alike. In some embodiments, the weight and torque applied to the reamer may be approximated and differentiated from that which is applied to the bit. In some embodiments, the weight and torque applied to the reamer in comparison to the bit may be displayed in real time, recorded, etc.

Figure 12:
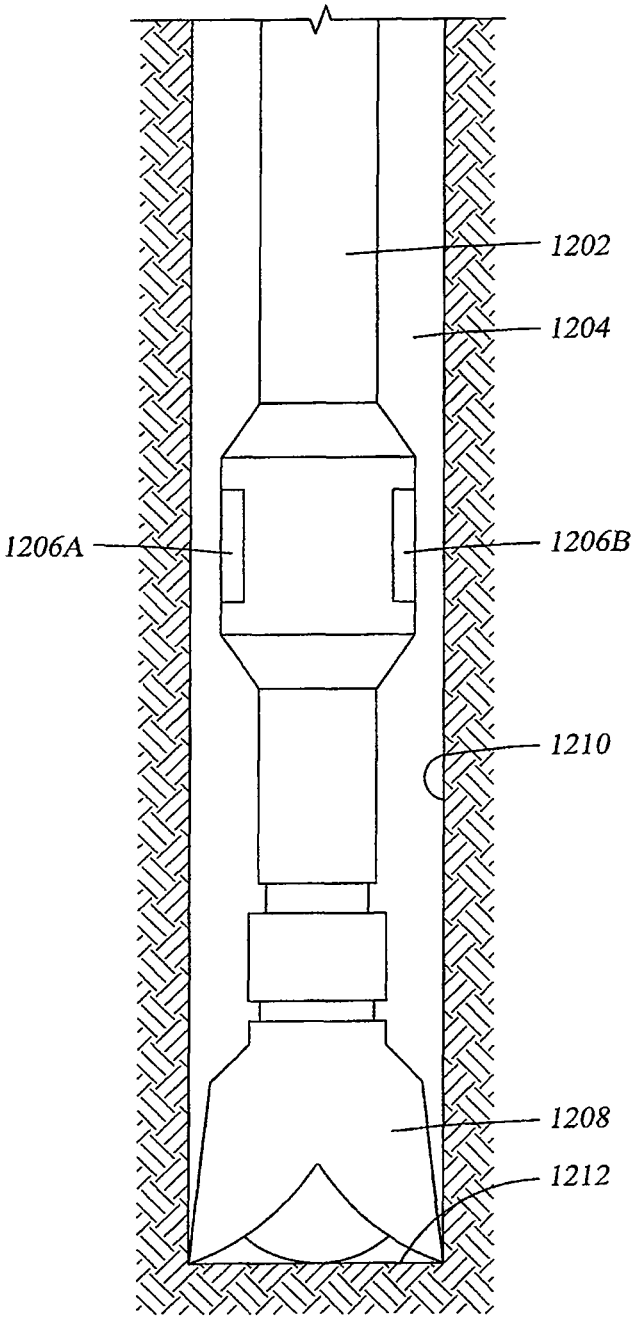
FIG. 12 illustrates a drilling operation wherein the reamer is not engaged and the drill bit is on the bottom, according to some embodiments of the invention.

In some embodiments, the configuration of the drilling operation is set to at least two configurations to establish two different data points. FIG. 12 illustrates a drilling operation wherein the reamer is not engaged and the drill bit is on the bottom, according to some embodiments of the invention. FIG. 12 illustrates a drill string 1202 in a borehole 1204 having sides 1210. The drill string 1202 includes reamers 1206A-1206B which are not extended to engage the sides 1210. A drill bit 1208 at the end of the drill string 1202 is at the bottom 1212 of the borehole 1204. In some embodiments, sensor(s) may determine the torque at the surface. Moreover, sensor(s) may determine the differential pressure while at a normal operating flow rate with the drill bit 1208 on-bottom, at a known WOB, with the reamers 1206A-1206B not engaged, to establish a primary data point. A second data point is then established. In particular, the same parameters (surface torque and differential pressure) may be accessed, while the drill bit 1208 is on bottom drilling, at a different WOB, and the reamers 1206A-1206B are not engaged.

Figure 13:
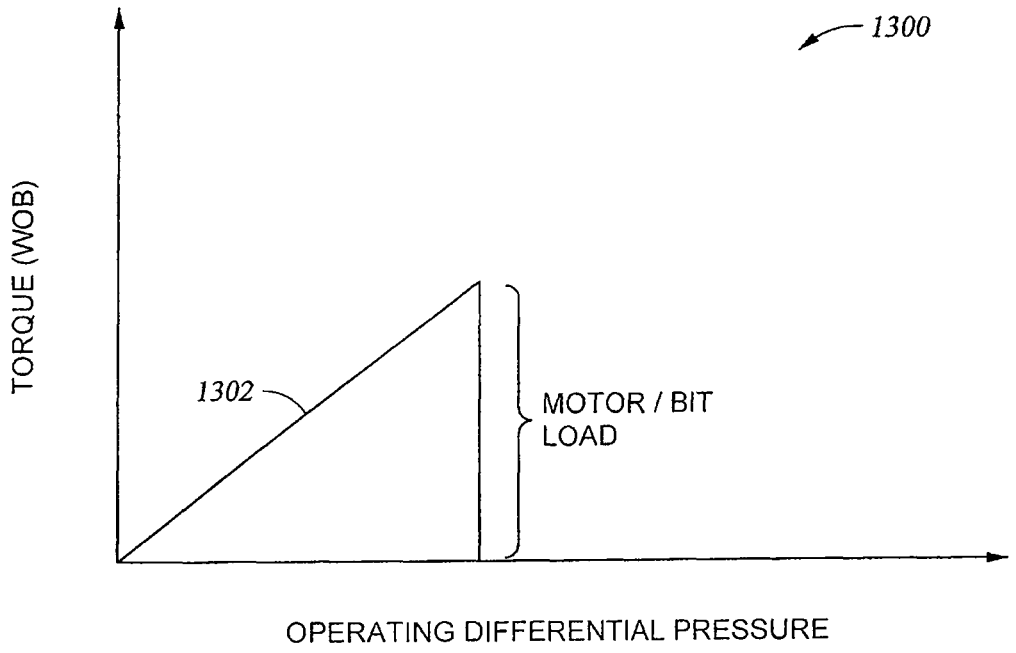
FIGS. 13-14 illustrate graphs of the torque relative to the operating differential pressure for a downhole drilling motor or a rotary steerable tool, according to some embodiments of the invention.
Figure 14:
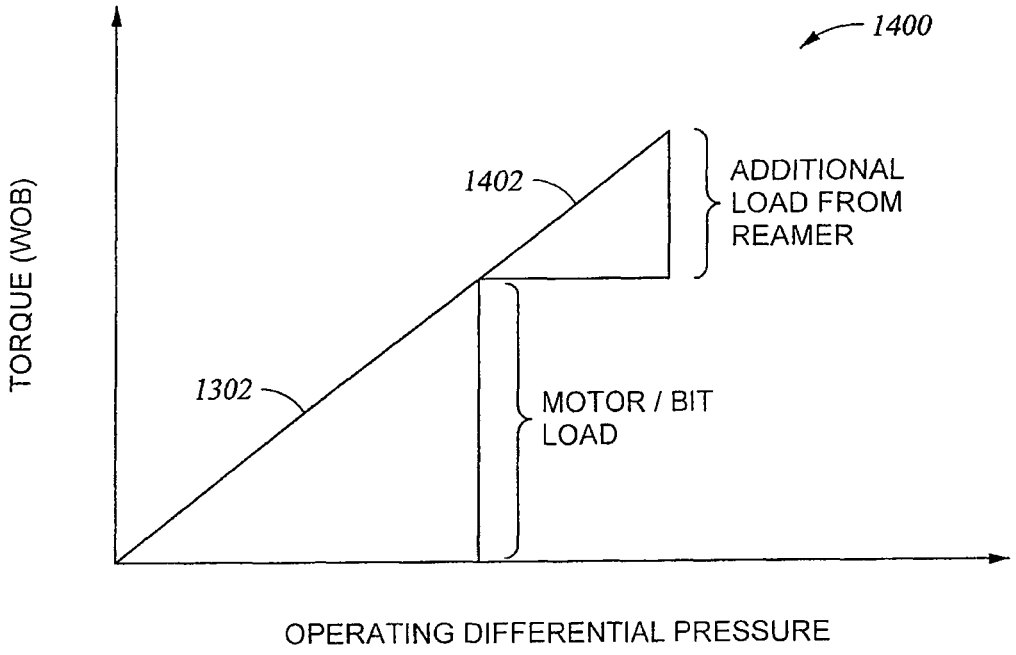

The two data points may be used to calculate the slope of a line. In particular, FIGS. 13-14 illustrate graphs of the torque relative to the operating differential pressure for a downhole drilling motor, according to some embodiments of the invention. In the graphs 1300 and 1400, the difference in differential pressure and the calculated slope are related to previously known functional characteristics of the specific power unit (see the line 1302 in FIGS. 13-14). In some embodiments, any deviation of the calculated slope or extension of the line beyond the calculated intersection on the torque/Δ curve, is attributed to the hole opener/reamer and hence the torsional loading and rotational motion of the drill bit can be separated from that of other BHA components (see the extension 1402 in FIG. 14).

In some embodiments, this distribution of the loads may be displayed in one of the GUI screens (as described above). These graphical representations may facilitate intervention prior to the onset of stick-slip and lateral vibration. Moreover, this monitoring of the distribution may allow for the approximating of the functionality of additional down hole instrumentation or that of an instrumented motor without providing additional down hole sensors, independent of and without altering existing motor designs.

In some embodiments, the interpretation of motor differential operating pressure can be used to evaluate the forces required to overcome static inertia and friction losses related to other tools which are run below motors, such as rotary steerable tools and adjustable gauge stabilizers. In many high angle and tight hole applications this can be an issue where differential pressure is applied to a drilling motor and the resulting torsional loading is then applied to the tools below the motor. However, rotation of the tools below the motor is not established. Thus, the frictional and tool weight losses are overcome by the applied motor torsion and the tools abruptly begin to rotate. This can cause mechanical loading issues with the tools below the motor in terms of mechanical and electronic components within. Internal motor components can also be adversely affected.

In some applications, the amount of power required to overcome the mechanical loadings caused by the tools below the motor may leave only a limited amount of remaining power with which to undertake the drilling process. The graphical and numerical representations (as described herein) may provide a real-time indication of this problem. Accordingly, directional drilling personnel may adjust drilling operations as required. In some applications tools run below motors may, at times, need to be operated on very low flow rates with small differential pressures in order for such tools to be correctly configured or to perform certain functions.

Embodiments of the graphical and numerical representations may aid in the above scenarios. The more subtle start-up and low level motor operating aspects are often not observable at surface by the directional driller. Embodiments may process relevant data and through these graphical and numerical representations indicate fluctuations in the drill bit rotation and in drilling motor output torque and RPM characteristics. Some embodiments may be applicable to rotary drilling assemblies where there is no drilling motor in the bottom hole drilling assembly.

General

In the description, numerous specific details such as logic implementations, opcodes, means to specify operands, resource partitioning/sharing/duplication implementations, types and interrelationships of system components, and logic partitioning/integration choices are set forth in order to provide a more thorough understanding of the present invention. It will be appreciated, however, by one skilled in the art that embodiments of the invention may be practiced without such specific details. In other instances, control structures, gate level circuits and full software instruction sequences have not been shown in detail in order not to obscure the embodiments of the invention. Those of ordinary skill in the art, with the included descriptions will be able to implement appropriate functionality without undue experimentation.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In view of the wide variety of permutations to the embodiments described herein, this detailed description is intended to be illustrative only, and should not be taken as limiting the scope of the invention. What is claimed as the invention, therefore, is all such modifications as may come within the scope and spirit of the following claims and equivalents thereto. Therefore, the specification and drawings are to be regarded in an illustrative rather than a restrictive sense.

What is claimed is:

1. A method comprising:

performing a directional drilling operation using a drill string having a drilling motor and cutting structures that include a drill bit and a reamer;

receiving data from one or more sensors, wherein at least one of the one or more sensors output data related to at least one performance attribute associated with load monitoring between the drill bit and the reamer, wherein the load monitoring is distributed between the drill bit and the reamer by the drilling motor, and wherein the at least one performance attribute comprises a differentiation of distribution of at least one of a weight and a torque applied to each of the drill bit and the reamer; and displaying the data related to the at least one performance attribute associated with the load monitoring in a graphical and numerical representation on a graphical user interface screen including displaying a graphical representation of torque relative to an operating differential pressure across the drilling motor comprising displaying a line having a slope attributed to the drill bit and a deviation of the slope attributed to the reamer.

2. The method of claim 1, wherein displaying the line having the slope further comprises displaying an extension of the line beyond an intersection of the torque/Δ curve that is attributed to the reamer.

3. The method of claim 1, wherein the drill string comprises a rotary steerable tool to which the drilling motor is to transmit torque and rotation, and wherein displaying the data comprises displaying a numerical representation of performance of the rotary steerable tool.

4. The method of claim 1, wherein displaying the data comprises displaying a graphical representation of a cross section of the drilling motor.

5. The method of claim 1, further comprising controlling the directional drilling operation based on the data related to the at least one performance attribute associated with the load monitoring.

6. One or more non-transitory machine-readable media comprising program code, the program code to:

receive data from one or more sensors during a directional drilling operation of a wellbore using a drill string having a drilling motor and cutting structures that include a drill bit and a reamer, wherein a first sensor of the one or more sensors is positioned at a surface of the wellbore to detect a torque applied to each of the drill bit and the reamer and a second sensor of the one or more sensors is positioned downhole to detect a weight to each of the drill bit and the reamer, wherein at least one of the one or more sensors output data related to at least one performance attribute associated with load monitoring between the drill bit and the reamer, wherein the load monitoring is distributed between the drill bit and the reamer by the drilling motor, and wherein the at least one performance attribute comprises a differentiation of distribution of at least one of the weight and the torque applied to each of the drill bit and the reamer; and display the data related to the at least one performance attribute associated with the load monitoring in a graphical and numerical representation on a graphical user interface screen including displaying a graphical representation of torque relative to an operating differential pressure across the drilling motor comprising displaying a line having a slope attributed to the drill bit and a deviation of the slope attributed to the reamer.

7. The one or more non-transitory machine-readable media of claim 6, wherein the program code to display the line having the slope comprises program code to display the line having the slope including an extension of the line beyond an intersection of the torque/Δ curve that is attributed to the reamer.

8. The one or more non-transitory machine-readable media of claim 6, wherein the drill string comprises a rotary steerable tool to which the drilling motor is to transmit torque and rotation, and wherein the program code to display comprises program code to display a numerical representation of performance of the rotary steerable tool.

9. The one or more non-transitory machine-readable media of claim 6, wherein the program code to display the data comprises program code to display a graphical representation of a cross section of the drilling motor.

10. The one or more non-transitory machine-readable media of claim 6, wherein the program code comprises program code to control the directional drilling operation based on the data related to the at least one performance attribute associated with the load monitoring.

11. A system comprising:

a drill string having a drilling motor and cutting structures that include a drill bit and a reamer to be positioned in a wellbore;

one or more sensors positioned in the wellbore or at a surface of the wellbore;

a processor; and a machine-readable medium having program code executable by the processor to cause the processor to:

receive data from the one or more sensors during a directional drill operation of a wellbore using the drill string, wherein at least one of the one or more sensors output data related to at least one performance attribute associated with load monitoring between the drill bit and the reamer, wherein the load monitoring is distributed between the drill bit and the reamer by the drilling motor, and wherein the at least one performance attribute comprises a differentiation of distribution of at least one of a weight and a torque applied to each of the drill bit and the reamer; and display the data related to the at least one performance attribute associated with the load monitoring in a graphical and numerical representation on a graphical user interface screen including displaying a graphical representation of torque relative to an operating differential pressure across the drilling motor comprising displaying a line having a slope attributed to the drill bit and a deviation of the slope attributed to the reamer.

12. The system of claim 11, wherein the program code executable by the processor to cause the processor to display the line having the slope comprises program code executable by the processor to cause the processor to display the line having the slope further comprises displaying an extension of the line beyond an intersection of the torque/Δ curve that is attributed to the reamer.

13. The system of claim 11, wherein the drill string comprises a rotary steerable tool to which the drilling motor is to transmit torque and rotation, and wherein the program code executable by the processor to cause the processor to display comprises program code executable by the processor to cause the processor to display a numerical representation of performance of the rotary steerable tool.

14. The system of claim 11, wherein the program code comprises program code executable by the processor to cause the processor to control the directional drilling operation based on the data related to the at least one performance attribute associated with the load monitoring.

* * * * *